United States Patent [19]

Hadley

[11] 3,996,869

[45] Dec. 14, 1976

[54] DIHEDRAL TUNNEL BOAT HULL

[76] Inventor: Robert O. Hadley, 2111 Bitter Creek Drive, Austin, Tex. 78744

[22] Filed: Sept. 8, 1975

[21] Appl. No.: 610,940

[52] U.S. Cl. ..... 114/56; 114/61; 114/66.5 S

[51] Int. Cl.[2] ..... B63B 1/06

[58] Field of Search ..... 114/56, 57, 61, 62, 114/66.5 R, 66.5 F, 66.5 S; 115/39

[56] References Cited

UNITED STATES PATENTS

| | | | |
|---|---|---|---|
| 3,067,711 | 12/1962 | Hesher et al. | 114/66.5 S |
| 3,160,134 | 12/1964 | Hillman et al. | 114/66.5 S |
| 3,796,177 | 3/1974 | Szptman | 114/66.5 F |
| 3,800,725 | 4/1974 | L'Heureux | 114/62 |
| 3,807,337 | 4/1974 | English et al. | 114/56 |

OTHER PUBLICATIONS

"Hot New Hulls", Travler Boat Brochure, 1964.

*Primary Examiner*—Trygve M. Blix
*Assistant Examiner*—Stuart M. Goldstein
*Attorney, Agent, or Firm*—Arnold, White & Durkee

[57] ABSTRACT

This invention is a boat hull designed for stable operation as a planing-type hull in rough water conditions. The hull is comprised of a substantially V shape central hull portion and a pair of adjacent side floats, one on each side of the central hull. The inner walls of the side floats are substantially vertical, and the floats are stepped upwardly at approximately midships, such that the rear portion of the side floats is substantially horizontal, or parallel to the plane of the water surface. The side floats extend deeper into the water than does the keel of the central hull. The dihedral tunnel is formed by the concavely curved surfaces of the central hull in combination with the inner walls of the side floats. At the point at which the central hull is deepest, the side floats extend somewhat deeper into the water, the amount of this differential being dependent upon the length of the hull.

9 Claims, 8 Drawing Figures

1
2
5
6
7
8
11
13
14
15
16
17
18
19
20

2
3
4
5
6
7
8
10
12
13
14
15
16
17
18
20

DIHEDRAL TUNNEL BOAT HULL

BACKGROUND OF THE INVENTION

This invention relates to boat hulls generally, and more particularly to planing type hulls. Planing type hulls are designed to move generally over the water rather than through it, as do displacement type hulls. Planing can be defined as that stage at which dynamic forces due to the motion of the hull through the water begin to make their influence felt.

Many hulls have in the past been designed to decrease the resistance of the hull moving through or over the water, and also to increase the directional stability of the hull while moving through or over the water. Attempts to achieve both of these objectives have been compromises because of the problems involved. To decrease the resistance to movement of the boat, the most desired form of hull is a flat plane since it draws the least water for its weight. The flat bottom type hull is a classic example of a planing type hull which tends to climb above the water to a full planing position from its in-the-water displacement position while at rest. However, the flat bottom hull lacks directional stability and pounds badly in choppy seas.

On the other hand, the most stable and softest riding hull in rough or choppy water is the deep V hull. The deep V hull usually has three or more lift or stability strakes running fore and aft on each side of the bottom. These trap air under the bottom so that the hull will ride on bubbles, thus reducing the displacement somewhat. The deep V hull generally lacks lateral stability. The reentry of the deep V hull in choppy water is stern first, because of the weight distribution, and because the sharp V cleaves the water for a softer landing. However, the deep V hull provides considerably more frontal resistance than the planing hull, thus resulting in considerable loss of planing performance. Moreover, even the deep V type hull is unstable in waves or choppy water when the hull direction is at an angle, that is, not perpendicular to the waves, thus giving rise to the tendency to side slip or tip over.

Attempts to alleviate the problem of the tendency of the deep V hull to side slip or tip over in turning situations have resulted in utilization of multi-hulls, also known as multiple-keel hulls. The side stabilizers of a multiple-keel hull are generally of the V type, and hence have the disadvantage of relatively high frictional resistance since they are not capable of planing. Various hulls are used for certain applications. For example, the cathedral tri-hulls have added lateral stability and greater load carrying capabilities. The cross-section of a cathedral hull looks like a deep V in the middle with shallower Vs on each side. The riding qualities depend primarily on the center deep V. The side Vs trap air and run it under the hull, and cause the hull to run flat in a turn by propping up the usual deep V tendency to bank. The great advantages are stability (especially at slow speeds) and additional load carrying capability.

While the tunnel hull is essentially a planing type hull, it lacks desired directional stability. The crosssection of a tunnel hull looks like a deep V sawed with a flat horizontal section in the middle. The rush of trapped air in the tunnel helps provide dynamic lift. The advantage of the tunnel hull is great speed, while the principal disadvantages are the relatively high power needed and the low load carrying capability. Rough water performance is moderately good.

None of the hulls discussed above have incorporated a dihedral tunnel concept by means of a biplanar central hull portion with optimally deeper outside floats. Some quasi-hydro hulls have utilised a shallower central hull, but those designs were unstable in turns and in rough water; applicant believes the instability was due to the small difference in depth between the outer sponsons and the central hull.

It is believed that the ultimate in a boat hull design would be a planing type hull with absolute directional and lateral stability. It would be desirable to provide a boat hull which would at least aproximate the performance of a planing type hull, and at the same time provide for a high degree of directional stability and rough water performance. This invention provides such a boat hull.

More specifically, it is desired to provide a softer, smoother ride on and over rough water, with comfort and safety at speeds in excess of 30 mph, and to provide greater load carrying capabilities and additional usuable space. It is also desired to provide a hull configuration that will get the boat out of and on top of the water with a reduction of frontal resistance by means of a reduction of wetted surface, thus providing minimal resistance with greater efficiency to both hull and power drive.

Further, it is desired to relieve the shock impact of reentry of such a hull in rough and choppy water, and hence to provide smooth forward motion. It is also desired to provide improved stability through the incorporation of integral twin floats.

These features and others which will become apparent when reference is made to the following description and accompanying drawings are provided by this invention.

It is believed that achieving the objective of smoother ride in rough water requires the utilization, at least to some extent, of the V type hull. Historically, hull designs in which the V type hull was employed have resulted in considerable loss of the planing characteristic, and hence, considerable increase in longitudinal resistance. Employment of the V type hull in combination with other hull forms is a compromise, with the objective of solving the problems of substantial frontal resistance of V type hulls, and substantial directional instability and pounding of planing type hulls. The subject invention is likewise such a compromise. However, the resulting performance is substantially better than that obtained by previous hulls.

SUMMARY OF THE INVENTION

This invention, which employs a dihedral tunnel concept, includes a V type central hull, and twin sponson or float outer hulls. The outer floats have deeper draft than does the central hull and, once sufficient speed is attained, will approach the desired planing motion.

In order to overcome initial resistance to the central hull V form, the floats of this invention are similar to floats used on aircraft, with steps. The float steps, located at approximately midships, aid in overcoming suction, and they provide a clean break in the planing surface, to reduce skin friction.

The outer hull surfaces of the floats are similar to the traditional seaplane floats. However, the inner surfaces, being substantially vertical, form the inner sidewalls of a tunnel. The concept of a dihedral tunnel is derived from the two upper walls of the tunnel, rather than one flat upper surface as in a conventional tunnel hull. Previous hulls have also employed the idea of combination central V and exterior tunnel hulls, but have not attained the superior performance attained by the hull of this invention.

The dihedral tunnel concept results in substantially increased performance because of achievement of the planing effect, with the central hull riding higher, that is, shallower in the water. However, directional and lateral stability is not sacrificed, since the floats provide added stability. And, the central hull provides somewhat softer and smoother rides in rough or choppy water due to the dampening effect on impact of reentry in waves.

The reentry impact is greater dampened through the sharp lines and angular form of the floats that first contact the water, and then by the central V hull contacting the water. In addition, air flow partially entrapped under the hull in the tunnels formed by the interior walls of the floats adds to the cushioning effect. Trapping the air flow through the tunnels under the hull aids in providing greater dynamic lift as well as in dampening reentry.

DESCRIPTION OF THE DRAWINGS

In the drawings which form a part of this specification, a boat hull constructed in accordance with one preferred embodiment of the invention is shown out of the water.

DESCRIPTION OF PREFERRED EMBODIMENT

Figure 1:
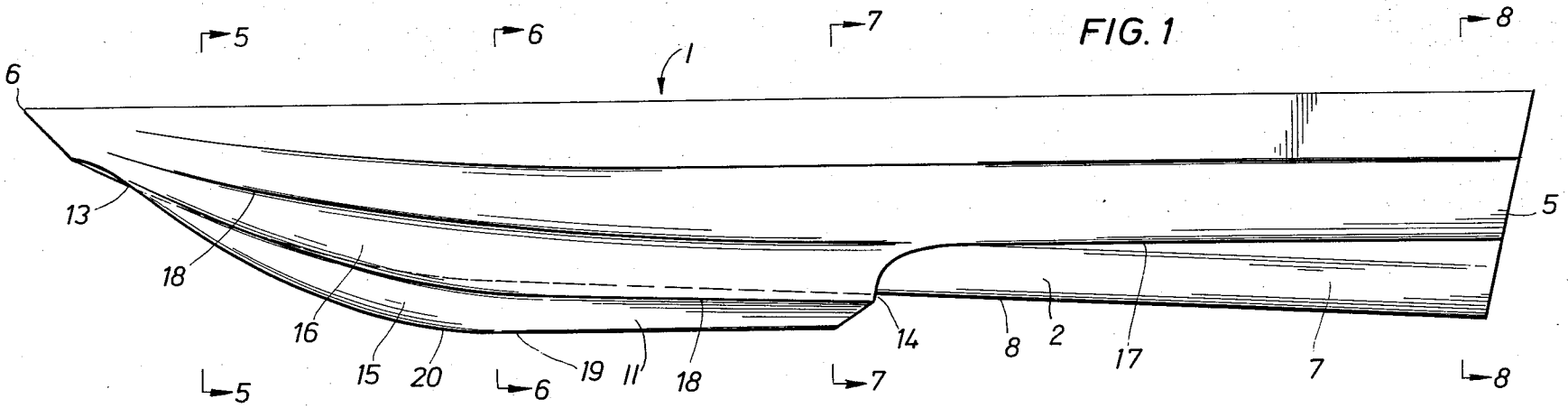
FIG. 1 is a side elevation of the boat hull of such embodiment.

The invention will be explained in detail by means of reference to the preferred embodiment shown in the drawings. This embodiment is believed to represent the best mode of the invention at the time of this application. Explanation of this embodiment assumes that the boat is oriented in its customary position of use.

Figure 2:
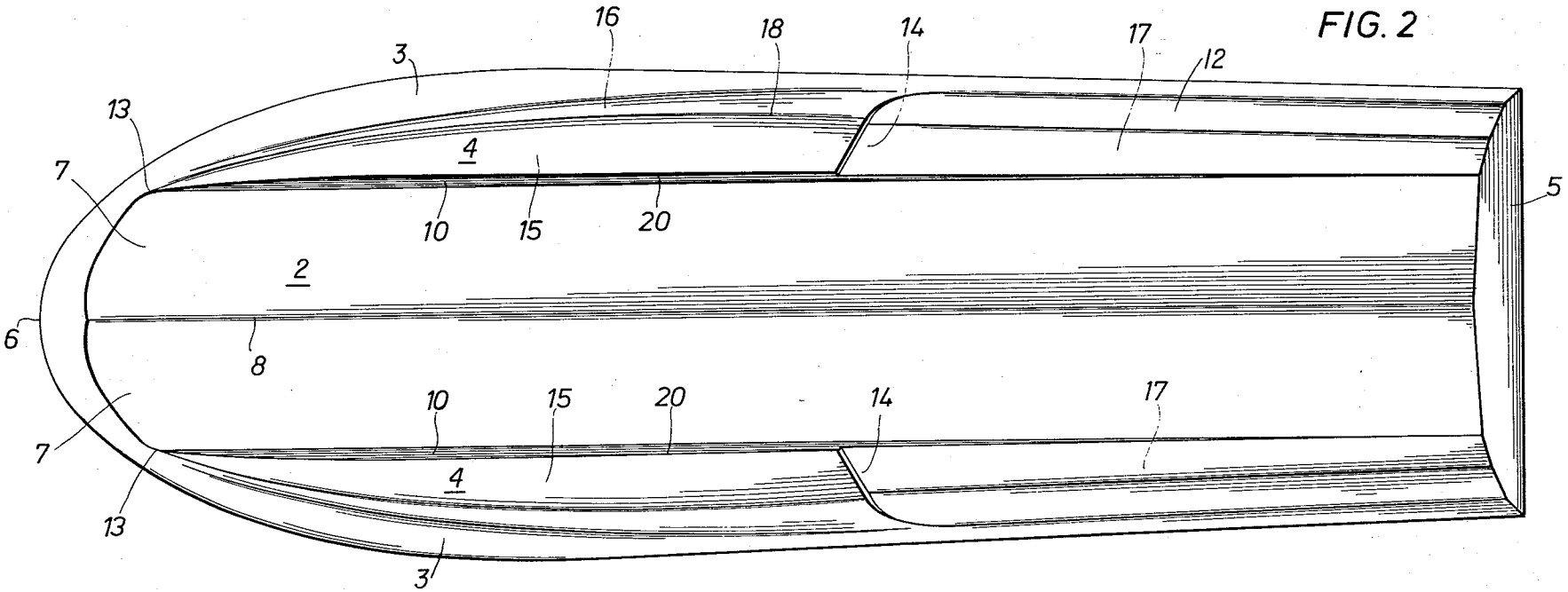
FIG. 2 is a bottom plan view of the boat hull shown in FIG. 1.
Figure 3:
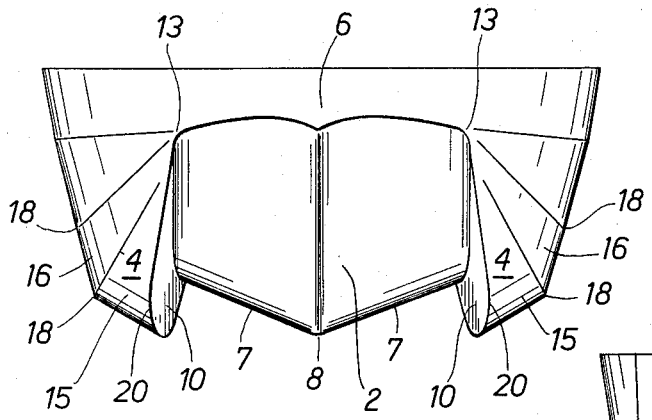
FIG. 3 is a front view of the boat hull shown in FIG. 1.

Referring now to FIGS. 1–2, there is shown a boat hull 1 comprising generally a central hull portion 2 and like side portions 3. The side portions 3 of the boat hull 1 include identical, coextensive side floats 4, these floats being integral with the side portions 3 adjacent the central hull portion 2.

The central hull portion 2, from the transom 5 to the bow 6, is of the V variety. The forward portion of the central hull 2 consists of two slightly concave sides, the central hull surfaces 7, joined at the keel 8. The central hull 2 is increasingly rounded from the deepest point 19 of the boat hull 1 rearward toward the transom 5, at which point the configuration of the central hull 2 is slightly convex. The curved bottom portion of the central hull 2 near the transom 5 is an important factor contributing to the stability of the hull 1 in turns, and in reducing propeller cavitation. The keel 8 along this rounded portion is shown by broken lines in FIG. 2. The central hull surfaces 7 extend outwardly and upwardly toward the inside surfaces 10 of the floats 4. Such surfaces desirably have a slightly concave curvature.

Figure 4:
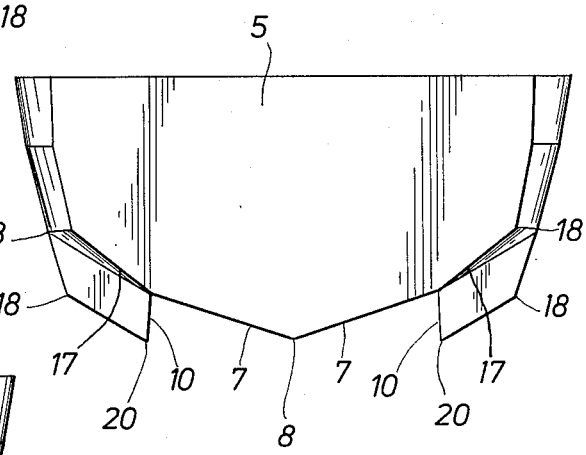
FIG. 4 is a rear view of the boat hull shown in FIG. 1.
Figure 5:
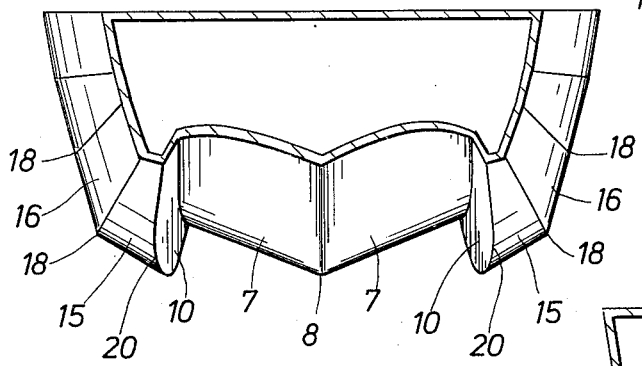
FIGS. 5–8 are lateral sectional views of the boat hull, the planes of view being indicated by lines 5—5 through 8—8 respectively, shown in FIG. 1.

Each of the floats 4 is comprised of two portions, of forward portion 11 and rear portion 12. The forward portion 11 extends from the point 13 at the bow 6, to the front portion of the steps 14, and is disposed at a greater depth than the central hull 2. The float rear portions 12 extend to the transom 5, aft of the steps 14, and are disposed shallower than the central hull 2. The floats 4 are comprised of inner surfaces 10, lower forward outer surfaces 15, upper forward outer surfaces 16, and rearward bottom surfaces 17. The floats' inner surfaces 10 are substantially vertical, being at an angle A of about 3 degrees from the vertical. This small angle allows for easy removal of the boat hull 1 from a mold (the preferred embodiment is fiberglass molded). The inner surfaces 10 of the floats 4 act as stabilizers to prevent the hull 1 from sideslipping while turning. The angle A is measured between the vertical plane and the plane formed by the inner surfaces 10, of the floats 4, as shown in FIG. 4. The upper and lower forward outer surfaces 16 and 15, respectively, extend outwardly and upwardly to longitudinally extending strakes 18. The strakes 18 run the length of the boat hull 1 and serve two purposes: (1) they prevent water from running up the side of the boat, and (2) they tend to trap air and run it under the bottom of the strakes 18 so that the floats 4 will ride on bubbles. The rear bottom surface 17 of each float 4 narrows toward the transom 5 because the angle of the upper forward outside surfaces 16 of the floats 4 is substantially increased from bow 6 to transom 5 with respect to an imaginary vertical plane extending from the bow 6 to the transom 5, along the keel 8 of the central hull 2.

Figure 6:
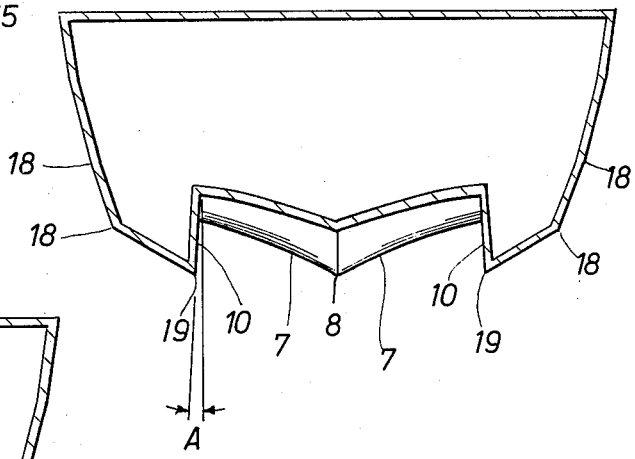
Figure 7:
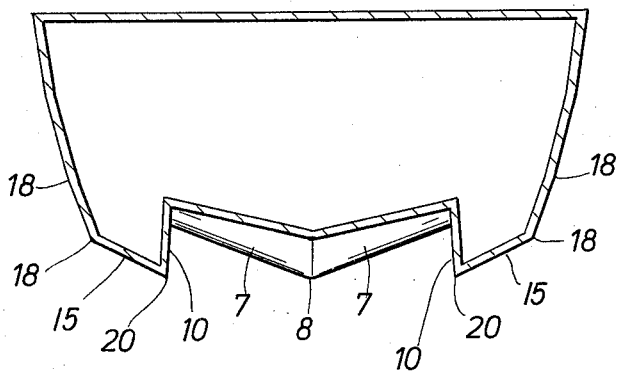
Figure 8:
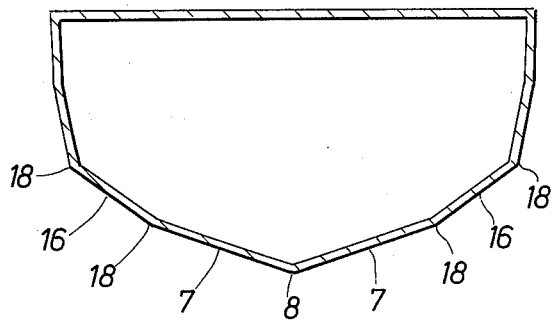

At point 19 (See FIG. 6), the floats 4 extended deepest into the water, and also deeper into the water than the central hull 2. The greatest difference in depth between the draft of the central hull 2 and that of the floats 4 is also indicated at the point 19. The shape of the hull 1 at this point is illustrated in FIG. 6.

The central hull 2 is V shaped so that the boat will ride with greater stability in rough water, and will support heavier payloads. Generally, the V shaped hull cuts through rough, choppy waves without slapping down uncomfortably hard on the water surface. The bottom edges 20 of the float forward portions 11 are formed by the substantially vertical inner float surfaces 10 and the lower outer float surfaces 15. The knife-like shape of these float edges 20 also aids in rendering the operation of the boat hull 1 much smoother in rough water, but the real importance of the design is in the dihedral tunnel that results from the combination of the central hull 2 and the floats 4. The desirable effects of a tunnel-type hull are obtained by this concept, without sacrificing the desirable effects of a V-type hull. In addition, greater load carrying capability is attained. The objectives of providing a boat hull design that is stable in choppy water and also operable at high speeds with minimal drag in smooth or rough water are thus effected with the instant design.

The dihedral tunnel concept results from the combination of the two central hull surfaces 7, which form the top biplanar portion of the tunnel, and the floats' inner surfaces 10, which form the tunnel sidewalls. Critical to the dihedral tunnel design is the parameter defining the different depths of the central hull 2 and the floats 4 at various points along the length of the hull 1. These determinations are critical because of their effect on the handling and stability of the boat hull 1.

The depth of the central hull 2 is defined with respect to the depth of the floats 4 and also the point at which the floats are stepped. The elevational difference between the depth of the central hull 2 and the depth of the floats 4 is substantial in this invention, and that substantial difference is a key and critical feature of this invention.

The longitudinal location of the steps 14 is desirably approximately midships. In the case of multiple steps, the forwardmost step is located about midships. The depth of the keel 8 of the central hull 2 at the point at which the floats 4 are stepped may be defined as follows: the angle between the keel line extending forwardly from the transom 5 and the imaginary plane formed by lines extendng forwardly from the keel 8 at the transom 5 to the lowermost points on the floats 4 at the steps 14 should be between 3° and 4°. The greatest variable in this determination is thus the location of the steps 14. With the step location at approximately the center of gravity of the boat with natural loading, as in the preferred embodiment, this elevational difference is three to four inches for a sixteen foot hull. That is, the vertical distance between the bottom of the central keel and the bottom of the floats at the point where they are stepped is between 3 and 4 inches for a 16 foot hull in the preferred embodiment. For a 20 foot hull, the difference between the draft of the central hull and the floats at the steps is desirably between 4 and 5 inches. For hull lengths of 40, 60, 80, and one hundred feet, these difference would be 8 to 10, 12 to 14, 15 to 19, and 20 to 24 inches, respectively. Previous hulls of this sort would, upon measurment, show a maximum elevational difference of about ½ inch for the 16 foot hull. The new design with the shallower central hull provides the substantially improved performance, believed by applicant to be on the order of at least 30 percent.

Stepped floats, as provided in this embodiment, are desirable employed to help break suction in approaching the planing speed, but without sacrificing directional stability since the central hull, in between the floats, provides cushioning buoyancy so necessary in rough or choppy water. Each step constitutes a clean break in the planning surface, for the three-fold purpose of reducing wetted surface and hence decreasing skin friction, breaking the suction under the afterbody, and increasing lift by means of the leading edge of the step.

The theory behind the steps is that water will miss contact with the forward portion of the following plane; the step ends a planing surface as does the transom. Multiple steps may be employed to enhance the effect, resulting in skin friction of wetted surface being reduced to as little as half that of stepless bottoms. Maximum lift is attained with multiple steps. The hull design, with the inner walls of the floats being substantially vertical, rather than inclined in a V, such as the sponsons in a cathedral or catamaran hull, contributes to the planing performance of the hull, but also allows for improved directional stability so as to prevent side slipping in a turn.

The combination of the stepped floats and the dihedral tunnel formed by the inner walls of the floats and the two surfaces of the central hull, coupled with the shallower draft of the central hull as compared to that of the floats, results in substantially increased performance with improved efficiency of both the hull and the power drive. The result of this combination is improved stability with high speed performance since the central hull absorbs the bumps of choppy water, but the floats and the draft thereof as compared to the keel of the central hull, provide the planing effect of a high performance tunnel-type hull. This combination results in a substantial decrease in the wetted surface of the boat while operating at moderate to high speeds.

It is believed that the shallower central hull design results in approximately 30 percent increased performance over a prior art design with little elevational difference between the central hull and floats. This estimated increase is based on improved stability in rough or choppy water, and also improved speed capability in either rough or calm water. The resultant performance of this hull configuration in alleviating instability, while providing the other advantages, is startlingly superior to that of previous designs.

The preferred embodiment is fiberglass molded. While the hull as disclosed and claimed may be constructed of various materials such as wood planks secured to a frame, this explanation of the preferred embodiment assumes that the hull described is a one piece molded plastic or fiberglass hull. The preferred embodiment of the invention has been illustrated, described, and disclosed, but changes and modifications resulting in other embodiments of the hull may be made, and some features of the invention can be used in different combinations without departing from the scope of the invention as defined by the appended claims.

What is claimed is:

1. A boat hull designed for stable operation as a planing-type hull in rough water conditions, said hull having a bow and transom, a forward portion extending from said bow to approximately midships, and a rear portion extending from approximately midships to said transom, comprising a substantially V-shaped central hull portion having a keel extending along a longitudinal axis from said bow to said transom, and a pair of coextensive and adjacent side floats, one on each side of said central hull, said side floats being longitudinally symmetrical about said longititudinal axis, each of said side floats having an outer surface inclined upwardly and outwardly with respect to said central hull extending over said forward portion a bottom portion stepped upwardly to a substantially planar surface extending over said rear portion, and a substantially vertical inner wall surface adjacent said central hull defining, in combination with said central hull, a dihedral tunnel, and forming, in combination with said outer surface, a bottom edge of said float, said edge extending to a depth greater than that of said keel of said central hull, over a substantial length of said forward portion.

2. A boat hull in accordance with claim 1, wherein said bottom portion of each float becomes progressively narrower toward the transom.

3. A boat hull in accordance with claim 1, wherein said outer surfaces have longitudinally extending strakes.

4. A boat hull in accordance with claim 1, wherein said hull is about 16 feet in length, and said side floats are three to four inches deeper than said central hull at the location of the upwardly stepped portions of said floats.

5. A boat hull in accordance with claim 1, wherein said hull is about 20 feet in length, and said side floats are four to five inches deeper than said central hull at the location of the upwardly stepped portions of said floats.

6. A boat hull in accordance with claim 1, wherein said hull is about 40 feet in length, and said side floats are eight to 10 inches deeper than said central hull at the location of the upwardly stepped portions of said floats.

7. A boat hull is accordance with claim 1, wherein said hull is about 60 feet in length, and said side floats are 12 to 14 inches deeper than said central hull at the location of the upwardly stepped portions of said floats.

8. A boat hull in accordance with claim 1, wherein said hull is about 80 feet in length, and said side floats are 15 to 19 inches deeper than said central hull at the location of the upwardly stepped portions of said floats.

9. A boat hull in accordance with claim 1, wherein said hull is about 100 feet in length, and said side floats are 20 to 24 inches deeper than said central hull at the location of the upwardly stepped portions of said floats.

* * * * *